US010294571B2

(12) United States Patent
Vaughn et al.

(10) Patent No.: US 10,294,571 B2
(45) Date of Patent: May 21, 2019

(54) COLORATION OF ELECTROLESS NICKEL PLATING BY APPLICATION OF COLD BLUING SOLUTIONS

(71) Applicant: Legal Manufacturing, LLC, Ringgold, GA (US)

(72) Inventors: Stephen Bryan Vaughn, Ringgold, GA (US); Derek Scott Kozlowski, Rocky Face, GA (US)

(73) Assignee: Legal Manufacturing, LLC, Ringgold, GA (US)

( * ) Notice: Subject to any disclaimer, the term of this patent is extended or adjusted under 35 U.S.C. 154(b) by 0 days.

(21) Appl. No.: 15/386,210

(22) Filed: Dec. 21, 2016

(65) Prior Publication Data

US 2017/0175273 A1 Jun. 22, 2017

Related U.S. Application Data

(60) Provisional application No. 62/270,382, filed on Dec. 21, 2015.

(51) Int. Cl.

| | |
|---|---|
| ***C23C 22/58*** | (2006.01) |
| ***C23C 18/16*** | (2006.01) |
| ***C23C 18/32*** | (2006.01) |

(52) U.S. Cl.

CPC ..... *C23C 22/58* (2013.01); *C23C 18/1689* (2013.01); *C23C 18/32* (2013.01)

(58) Field of Classification Search

CPC ..... C23C 22/58

See application file for complete search history.

(56) References Cited

U.S. PATENT DOCUMENTS

| | | | | | |
|---|---|---|---|---|---|
| 2,527,232 | A | * | 10/1950 | Scroxton | C23C 22/50 148/271 |
| 2,846,343 | A | * | 8/1958 | Mason | C23C 22/56 148/270 |
| 2,933,422 | A | * | 4/1960 | Mason | C23C 22/40 106/1.26 |
| 3,210,220 | A | | 10/1965 | Ne et al. | |
| 3,615,747 | A | | 10/1971 | Friedman | |
| 4,544,089 | A | * | 10/1985 | Tabler | F41C 33/0236 224/192 |
| 4,728,365 | A | * | 3/1988 | Jarvi | C23C 22/50 106/1.05 |
| 5,643,055 | A | * | 7/1997 | Linzell | B24B 1/00 451/28 |
| 2006/0054248 | A1 | | 3/2006 | Straus | |

(Continued)

FOREIGN PATENT DOCUMENTS

| | | | |
|---|---|---|---|
| KR | 100565968 B1 | | 11/2005 |
| KR | 20050107131 A | * | 11/2005 |

OTHER PUBLICATIONS

How to Blacken Nickel Silver. Grips and Reel Seats. retrieved from http://www.rodbuildingforum.com/index.php?showtopic=18144. Mar. 2008. (Year: 2008).*

(Continued)

*Primary Examiner* — Cachet I Sellman

(74) *Attorney, Agent, or Firm* — Thomas I Horstemeyer, LLP

(57) ABSTRACT

Disclosed herein are methods relating to the coloring of nickel-plated materials.

21 Claims, 1 Drawing Sheet
(1 of 1 Drawing Sheet(s) Filed in Color)

Upper Receiver Plated in NiB and Colored Black by Acidic Process

(56) References Cited

U.S. PATENT DOCUMENTS

| | | | | |
|---|---|---|---|---|
| 2007/0175389 | A1* | 8/2007 | Husmann | B05B 15/0481 118/504 |
| 2013/0202910 | A1* | 8/2013 | Koppe | C23C 18/1644 428/596 |
| 2013/0333262 | A1* | 12/2013 | McClave | F41A 17/42 42/70.05 |
| 2015/0225570 | A1 | 8/2015 | Konishi et al. | |

OTHER PUBLICATIONS

Blacken-It. Model Railroader forum. retrieved from http://cs.trains.com/mrr/f/88/t/170880.aspx. Mar. 2010 (Year: 2010).*

International Search Report dated Mar. 10, 2017 in corresponding International Application No. PCT/US16/67955 filed Dec. 21, 2016.

* cited by examiner

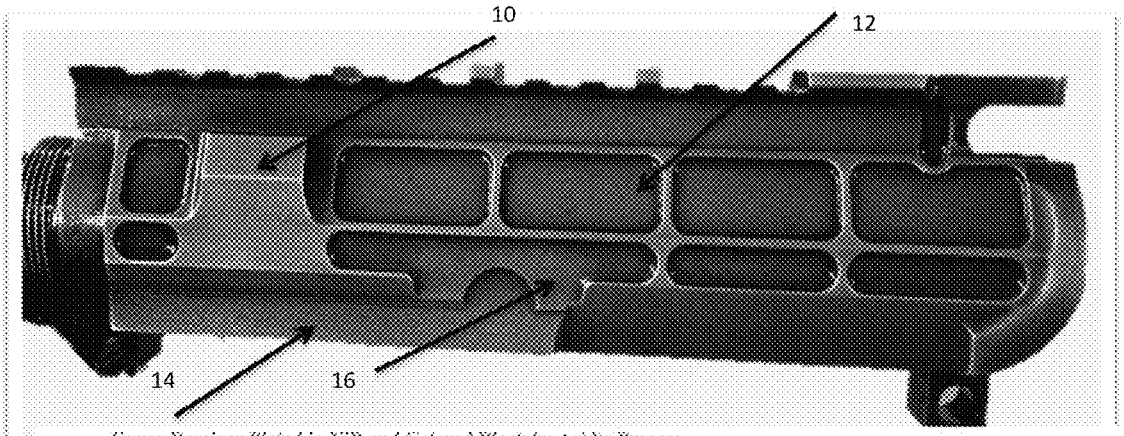
Upper Receiver Plated in NiB and Colored Black by Acidic Process

COLORATION OF ELECTROLESS NICKEL PLATING BY APPLICATION OF COLD BLUING SOLUTIONS

CLAIM OF PRIORITY TO RELATED APPLICATION

This application claims priority to U.S. provisional application entitled "Coloration of Electroless Nickel Plating by Application of Cold Bluing Solutions" having Ser. No. 62/270,382, filed on Dec. 21, 2015, which is entirely incorporated herein by reference.

TECHNICAL FIELD

The present disclosure is directed towards the darkening or coloring of surface[s] of electroless nickel (Ni) materials or electroless (Ni)-plated materials that are typically silver in color.

BACKGROUND

Changing the appearance of nickel or nickel-plated materials, such as gun parts, through coloration or selective coloration is a desirable method gun owners, manufacturers, hobbyists, and enthusiasts embrace to improve the aesthetics of firearms. Some popular techniques used for coloration, such as "bluing" or "cold bluing", work well for steel or other ferrous parts but not very well for non-ferrous parts, such as nickel parts and/or Ni-plated parts.

Current methods to change the appearance of Ni-plated materials have therefore been limited to the application of a paint coating, such as commercially available in Cerakote™ coatings, or the application of a physical vapor deposition (PVD) or diamond-like carbon (DLC) coating process. The application of paint offers a variety of colors for the finished product, but does not give a durable finish. PVD and DLC applications provide a very durable and extremely hard surface, but are quite brittle.

"Bluing" or "Cold Bluing" of steel has been well known in the industry for use on ferrous metal parts to provide some corrosion resistance, and a dark, black color. These coloring compounds or solutions are meant to be used on ferrous metals, primarily those alloys with a low chromium and nickel content. These products and the related trade literature consistently warn against their use on nonferrous materials, or those that contain high amounts of nickel.

Accordingly, there is a need to address the aforementioned needs and deficiencies relating to changing the coloration of nickel (Ni) and Ni-plated materials.

SUMMARY

Provided herein are methods for the coloration of an electroless nickel surface or an electroless nickel-plated surface comprising the steps of: providing the surface and coloring the surface with a coloring solution.

The surface can be an electroless nickel-boron, polytetrafluoroethylene-nickel, nickel-boron nitride, or nickel-phosphate surface or a nickel-plated surface.

Coloring solutions as described herein can comprise a selenium solution, a copper solution, and one or more acids. The selenium solution can be $H_2SeO_3$. The one or more acids can be at least one of nitric, phosphoric, and selenious, individually or in combination. The copper solution can be copper sulfate. The coloring solution comprises $H_2SeO_3$, copper sulfate, nitric acid, phosphoric acid, and water.

In an embodiment, a coloring solution can comprises $H_2SeO_3$, copper nitrate, nitric acid, phosophoric acid, and water. In another embodiment, a coloring solution can comprise $H_2SeO_3$, copper sulfate, nitric acid, phosophoric acid, and water. In another embodiment, a coloring solution can comprise $H_2SeO_3$, copper nitrate, hydrochloric acid, phosophoric acid, and water.

In an embodiment, a method for the coloration of an electroless nickel surface or an electroless nickel-plated surface can comprise providing the surface; pretreating the surface with an acid; and coloring the surface with a coloring solution.

In an embodiment, the acid can be hydrochloric acid, sulfuric acid, nitric acid, hydrofluoric acid, or fluoboric acid. In an embodiment, the acid can be about 5-30% hydrochloric acid. In an embodiment, the acid can be about 5-30% sulfuric acid. In an embodiment, the acid can be about 5-30% nitric acid.

In an embodiment, a method for the coloration of an electroless nickel surface or an electroless nickel-plated surface can comprise providing the surface; selectively patterning the surface with a masking device; and coloring the surface with a coloring solution.

A masking device can comprise a thin film polymer with adhesive backing, a polymer plug, or a chemical masking agent. A polymer plug can be PVC, PVDF, silicon, urethane, or rubber, individually or in combination.

Methods as described herein can comprise the step of selectively patterning the surface using a treatment agent with a treatment application device preceeding coloring said surface with a coloring solution.

Methods as described herein can comprise wetting the surface with a wetting solution and selectively abrading the surface with an abrasion device, preceeding coloring the surface with a coloring solution. In certain embodiments, wetting solutions can be water, the coloring solution, or light oil. In an embodiment an abrasion device can be an abrasion sponge wrapped with steel wool (e.g., #0000 steel wool).

Methods as described herein can comprise the step of rubbing high areas with burnishing materials preceeding abrading the surface with an abrasion device and preceeding cleaning surface with water, air, or cloth wiping.

Methods as described herein can further comprise drying and sealing with a sealant after coloring.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWING

The patent or application file contains at least one drawing executed in color. Copies of this patent or patent application publication with color drawing(s) will be provided by the Office upon request and payment of the necessary fee.

Many aspects of the disclosure can be better understood with reference to the following drawing. The components in the drawing are not necessarily to scale, emphasis instead being placed upon clearly illustrating the principles of the present disclosure. Moreover, in the drawing, like reference numerals designate corresponding parts throughout the several views.

FIG. 1 depicts an electroless Nickel Boron (NiB) plated aluminum Stoner model rifle upper receiver that has been colored black by the use of an embodiment of the present disclosure. The surface can be seen to have light and dark areas that appear to give a shadowed appearance to the receiver.

DETAILED DESCRIPTION

Described below are various embodiments of the present systems and methods for coloration of electroless nickel or electroless nickel-plated surfaces. Although particular embodiments are described, those embodiments are mere exemplary implementations of the present systems and methods. One skilled in the art will recognize other embodiments are possible. All such embodiments are intended to fall within the scope of this disclosure. Moreover, all references cited herein are intended to be and are hereby incorporated by reference into this disclosure as if fully set forth herein. While the disclosure will now be described in reference to the above drawings, there is no intent to limit it to the embodiment or embodiments disclosed herein. On the contrary, the intent is to cover all alternatives, modifications and equivalents included within the spirit and scope of the disclosure.

Discussion

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, synthetic inorganic chemistry, analytical chemistry, and the like, which are within the skill of the art. Such techniques are explained fully in the literature.

It is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Description

The present disclosure is directed to the coloring and/or patterning of a surface of an electroless nickel substrate or a surface of an electroless nickel (Ni)-plated substrate (herein referred to as a surface). Such surfaces are generally silver-colored in nature. A surface can be any surface of a part of a gun, firearm, or any other non-firearm surface that is suitable for electroless Ni-plating, or has been electroless Ni-plated, or is electroless Ni. A part of a gun (herein also referred to as a part) which has a surface or multiple surfaces can be, but is not limited to, an upper receiver, lower receiver, buffer tube, charging handle, rail, barrel, muzzle device, and other various miscellaneous gun parts.

The electroless nickel surface can be comprised of electroless nickel boron (ENi-B), electroless nickel phosphate (ENi-P), electroless polytetraflouroethylene nickel (PTFE-Ni), and/or electroless nickel boron nitride. For an electroless nickel-plated surface, the substrate underlying the nickel plating can comprise any suitable ferrous or non-ferrous metal and/or alloy. The surface is preferably an electroless nickel-plated surface that is plated onto an underlying aluminum substrate. The preferred plating is an electroless nickel-plating, such as electroless nickel boron (ENi-B) or electroless nickel phosphate (ENi-P), but can be any suitable electroless nickel-plating.

The use of chemical compounds in one or more coloring solutions, such as cold bluing solutions, can be applied according to the methods herein to give the surface (normally silver in color) a dark, or black, appearance.

Coloring solutions as described herein can comprise a selenium solution, a copper solution, and one or more acids. The selenium solution can be $H_2SeO_3$. The one or more acids can be at least one of nitric, phosphoric, and selenious, individually or in combination. The copper solution can be copper sulfate. The coloring solution comprises $H_2SeO_3$, copper sulfate, nitric acid, phosphoric acid, and water.

Commercially available or other suitable cold bluing solutions can contain $H_2SeO_3$, copper nitrate, nitric acid, phosphoric acid, and water. Other components of the solution can include, but are not limited to HCl, $CuSO_4$, and fluoboric acid.

With reference to FIG. 1, area 16 of the surface can be pretreated with one or more compounds that can chemically enhance the surface to be receptive to the coloring agent[s] (the pretreatment compounds also referred herein to as pretreatment agents). The pretreatment agents can be generally acidic in nature, such as nitric, sulfuric, phosphoric, acetic, hydrochloric, and selenic acids. Alternatively there are several alkaline compounds that have shown to give suitable results, such as NaOH. Hydrocholoric acid and sulfuric acid are preferred acidic treatment agents. When used as a pretreatment agent in the current method, sulfuric acid can impart a wider variety of shades or hues than other acids.

The surface can optionally be chemically cleaned and blasted with blast media before or after coloring. Suitable blast media can include one or more of aluminum oxide, glass bead[s], glass grit, ceramic bead, steel grit, or any number of other blasting compounds commercially available, preferably aluminum oxide of 120-180 grit before cleaning.

The surface can be uniformly colored or selectively colored by masking and/or selective pretreatment with a pretreatment agent. The surface can be colored in a variety of patterns to keep selected portions of the surface the original bright silver appearance, and the remaining portions of the part to be colored or to be black, or dull in appearance. In an embodiment, the selective coloring can be done using films that are applied directly to the surface (also known as "masking"), preventing the coloring solution and/or the pretreatment agent from pretreating the "masked" areas. Masking causes only unmasked areas to be colored or appear dark in color. In another embodiment, the surface can be selectively colored by painting or otherwise selectively applying a small amount (a small amount can be an amount sufficient to fully wet the surface in selective areas to get a darker color) of a pretreatment agent (such as HCl) only to certain areas that are desired to be colored or to be black or darker in color. The pretreatment agent can break down the nickel component and should be put into the bath within 15-20 mins or before fully drying. Application of the treatment agent to small areas of the surface can be accomplished with treatment application device, such as a small artist paint brush or other suitable application device, such as a sponge, dropper, syringe, spray bottle, synthetic swab. Using this method, only the areas where the pretreatment agent was selectively applied will become colored or dark in color.

The surface can also be made to mask defects in the underlying substrate by coloring the surface of the defect dark, such as shown in area 14 of FIG. 1. Applying a small amount of pretreatment agent to areas of the surface with a brush (or other application suitable application means, such as rubbing with a cloth) presenting small defects selectively etches these areas with the pretreatment agent and allows them to be colored dark with the coloring solution. The defect can then blend into the surrounding surface, appearing as a shadow on the surface.

This surface, once colored, can also be selectively abraded to lighten the color of one or more areas of the surface (such as area 10 in FIG. 1) imparting the appearance of wear in the lightened area(s). Additionally, the surface can be given visual depth by selective abrasion of areas to leave the appearance of shadows around those areas, such as area 12 in FIG. 1. This step can give the surface a "battle-worn", "age distressed", or "burnished" appearance, adding enhanced appeal to the consumer and selling benefit to the manufacturer. Abrasion can be performed with an abrasion device, such as Scotch Brite nonwoven abrasive pads, sanding sponges, steel wool, or abrasive buffing cloth on electric buffer wheel. Abrasion can preferably be performed with a sanding sponge of about 120-220 grit, or steel wool (e.g., #0000 steel wool). The surface can be kept wet with water, coloring solution, or preferably, but not limited to, light oil during abrasion. If light oil is used for wetting, it can be cleaned off after abrasion with acetone. The effect can further be enhanced with additional polishing and shining of worn areas with green Scotch-Brite™ or other suitable material[s] or composition[s]. A block or semi-rigid or rigid part can be used during abrasion, which can result in only the "high areas" or raised areas of the surface of the part to be abraded. This can leave the "low" areas of the surface untouched and can create a shadowed look.

Coloring, masking, pretreating, and abrading in the present method can be used in any combination and in any order. These steps can be repeated any amount of times until a desired coloration and/or patterning is obtained on a surface.

The surface can also optionally be provided with additional corrosion protection with a sealant following any combination of coloring, selective coloring, and abrasion. This can be particularly desirable when used in conjunction with electroless nickel-boron plating, which is porous, allowing moisture to reach the substrate. The sealant solution is preferably a non-film forming oil or other compound such as mineral spirits, light machine oil, or other such compound. Other embodiments can include solutions containing natural or synthetic waxes that can wick into the pores in the NiB and permanently seal the surface. The dark deposit formed by the coloring solution can fill the pores in the electroless nickel-boron plating and be sealed with a sealant, hindering moisture travel into the surface substrate and, thus, hinder corrosion of the part.

Provided herein are methods relating to the coloration, for example the bluing, of electroless nickel and electroless nickel-plated parts. The methods can be used to darken the coloration of said parts. They can also be modified to selectively color areas and/or defects on the surface or impart ornamental patterns and designs onto the surface of the parts. A black or darkened appearance can be applied uniformly or selectively to pre-determined areas of the material surface, enhancing the aesthetic appearance and/or covering surface defects. Additionally provided is a method for abrading the parts to selectively lighten the surface coloration after having been darkened.

The present disclosure provides various methods for coloration of a surface of an electroless nickel part or a nickel-plated part (also referred to herein as simply a "nickel surface") by application of cold bluing solutions.

In an embodiment, a surface is provided that is black or grey in color. The surface provided is either the surface of an electroless nickel part or the surface of an electroless nickel-plated part.

In a second embodiment, the surface can be selectively colored in lighter or darker areas on the same surface.

In a third embodiment, the surface can be abraded to give the appearance of age or wear on selected areas of the surface, for example selective areas of, the darkened surface.

In a fourth embodiment, the surface is can be masked to inhibit the treatment of the surface to create patterns on the finished substrate.

In a fifth embodiment, a surface is provided that imparts dullness to the surface such that it is not light reflective.

In a sixth embodiment, a surface is provided that is dark in color but does not become brittle or fracture.

In a seventh embodiment, a surface is provided that will not delaminate from a NiB plated surface.

The provided surface in one or any embodiments can optionally be cleaned, blasted, and/or chemically treated with a pretreatment agent before coloring.

The surface can be colored uniformly with a coloring solution.

The surface can be pretreated with an acid uniformly to enhance color uptake and then uniformly colored.

The surface can be selectively masked and then selectively colored with a coloring solution.

The surface can be selectively masked and selectively pretreated with an acid to enhance coloring of coloring solution in unmasked areas, and then selectively colored with a coloring solution.

The surface can be rubbed with coloring solution to enhance coloration of areas that have been rubbed with said coloring solution.

The surface can be selectively pretreated with an acid by selective application of said acid with a small brush and then colored.

Areas that are treated can be darkened by the coloring solution. Areas that are pretreated can show enhanced coloration. Following coloration, the surface can optionally be cleaned and sealed with a sealant. If desired, the surface can be abraded before coloring with a blast media. The surface can also be or abraded by rubbing with an abrasive device and then polished before cleaning and sealing to impart a worn, burnished, or battle-worn look.

The following examples are put forth describing in various aspects how our present process can be carried out so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is in bar. Standard temperature and pressure are defined as 0° C. and 1 bar.

Example 1

The surface of a gun part can first be plated with an appropriate electroless nickel plating. In this embodiment, the plating can be electroless nickel-boron (EN-B), but also can be electroless nickel-phosphate (EN-P), electroless polytetraflouroethylene-nickel (PTFE-N), or electroless nickel-boron-nitride.

The part can then submerged in a coloring solution containing $H_2SeO_3$, copper nitrate, nitric acid, phosphoric acid, and water. Other components of the solution can include, but are not limited to HCl, $CuSO_4$, and fluoboric acid. The part can be submerged for about 30 seconds to about 10 minutes, but preferably about 3 minutes to about 5 minutes, and then removed from the solution.

Example 2

The surface of a gun part can first be plated with an appropriate electroless nickel plating. In this embodiment, the plating can be electroless nickel-boron (EN-B), but can be electroless nickel-phosphate (EN-P), electroless polytetraflouroethylene-nickel (PTFE-N), or electroless nickel-boron-nitride.

The part can be cleaned in a chemical bath to remove any residual oils or other chemical contaminants on the surface.

The part can then be submerged in a coloring solution containing $H_2SeO_3$, copper nitrate, nitric acid, phosphoric acid, and water. Other components of the solution can include, but are not limited to HCl, $CuSO_4$, and fluoboric acid. The part can be submerged for about 30 seconds to about 10 minutes, but preferably about 3 minutes to about 5 minutes, and then removed from the solution.

Example 3

The surface of a gun part can first be plated with an appropriate electroless nickel plating. In this embodiment, the plating can be electroless nickel-boron (EN-B), but can be electroless nickel-phosphate (EN-P), electroless polytetraflouroethylene-nickel (PTFE-N), or electroless nickel-boron-nitride.

The part can be cleaned in a chemical bath to remove any residual oils or other chemical contaminants on the surface.

The part can be subjected to abrasive blasting to open the surface structure of the nickel or nickel-plating and remove any oxidation or contamination on the surface. The blast media can be any one or more of aluminum oxide, glass bead[s], glass grit, ceramic bead, steel grit, or any number of other blasting compounds commercially available. The blasting compound can be aluminum oxide in 120-180 grit size.

The part can then be submerged in a coloring solution containing $H_2SeO_3$, copper nitrate, nitric acid, phosphoric acid, and water. Other components of the solution can include, but are not limited to HCl, $CuSO_4$, and fluoboric acid. The part can be submerged for about 30 seconds to about 10 minutes, but preferably about 3 minutes to about 5 minutes, and then removed from the solution.

Example 4

The surface of a gun part can first be plated with an appropriate electroless nickel plating. In this embodiment, the plating can be electroless nickel-boron (EN-B), but can be electroless nickel-phosphate (EN-P), electroless polytetraflouroethylene-nickel (PTFE-N), or electroless nickel-boron-nitride.

The part can be cleaned in a chemical bath to remove any residual oils or other chemical contaminants on the surface.

The part can be subjected to abrasive blasting to open the surface structure of the nickel or nickel-plating and remove any oxidation or contamination on the surface. The blast media can be any one or more of aluminum oxide, glass bead[s], glass grit, ceramic bead, steel grit, or any number of other blasting compounds commercially available. The blasting compound can be aluminum oxide in 120-180 grit size.

The surface can be masked in the areas that are to be left untreated. This can be done with thin film polymer agents such as: adhesive backed vinyl that has been cut in a desired pattern; polymer plugs such as PVC, PVDF, silicon, urethane, or rubber; or chemical masking agents that are applied to the surface, such as wax or other polymer compounds, that can be applied wet and then dried.

The part can then submerged in a coloring solution containing $H_2SeO_3$, copper nitrate, nitric acid, phosphoric acid, and water. Other components of the solution can include, but are not limited to HCl, $CuSO_4$, and fluoboric acid. The part can be submerged for about 30 seconds to about 10 minutes, but preferably about 3 minutes to about 5 minutes, and then removed from the solution.

Example 5

The surface of a gun part can first be plated with an appropriate electroless nickel plating. In this embodiment, the plating can be electroless nickel-boron (EN-B), but can be electroless nickel-phosphate (EN-P), electroless polytetraflouroethylene-nickel (PTFE-N), or electroless nickel-boron-nitride.

The part can be cleaned in a chemical bath to remove any residual oils or other chemical contaminants on the surface.

The part can be subjected to abrasive blasting to open the surface structure of the nickel or nickel-plating and remove any oxidation or contamination on the surface. The blast media can be any one or more of aluminum oxide, glass bead[s], glass grit, ceramic bead, steel grit, or any number of other blasting compounds commercially available. The blasting compound can be aluminum oxide in 120-180 grit size.

The surface can be masked in the areas that are to be left untreated. This can be done with thin film polymer agents such as: adhesive backed vinyl that has been cut in a desired pattern; polymer plugs such as PVC, PVDF, silicon, urethane, or rubber; or chemical masking agents that are applied to the surface, such as wax or other polymer compounds, that can be applied wet and then dried.

The part can be selectively treated with an acidic treatment agent such as, but not limited to nitric acid, hydrochloric acid, acetic acid, phosphoric acid, sulfuric acid, fluoboric acid. The acid can be a dilute nitric acid, hydrochloric acid, or sulfuric acid of about 5% to about 30%.

The part can then be submerged in a coloring solution containing $H_2SeO_3$, copper nitrate, nitric acid, phosphoric acid, and water. Other components of the solution can include, but are not limited to HCl, $CuSO_4$, and fluoboric acid. The part can be submerged for about 30 seconds to about 10 minutes, but preferably about 3 minutes to about 5 minutes, and then removed from the solution.

Example 6

The surface of a gun part can first be plated with an appropriate electroless nickel plating. In this embodiment, the plating can be electroless nickel-boron (EN-B), but can be electroless nickel-phosphate (EN-P), electroless polytetraflouroethylene-nickel (PTFE-N), or electroless nickel-boron-nitride.

The part can be cleaned in a chemical bath to remove any residual oils or other chemical contaminants on the surface.

The part can be subjected to abrasive blasting to open the surface structure of the nickel or nickel-plating and remove any oxidation or contamination on the surface. The blast media can be any one or more of aluminum oxide, glass bead[s], glass grit, ceramic bead, steel grit, or any number of other blasting compounds commercially available. The blasting compound can be aluminum oxide in 120-180 grit size.

The surface can be masked in the areas that are to be left untreated. This can be done with thin film polymer agents such as: adhesive backed vinyl that has been cut in a desired pattern; polymer plugs such as PVC, PVDF, silicon, urethane, or rubber; or chemical masking agents that are applied to the surface, such as wax or other polymer compounds, that can be applied wet and then dried.

The part can be selectively treated with an acidic treatment agent such as, but not limited to, hydrochloric acid, acetic acid, phosphoric acid, sulfuric acid, fluoboric acid. The acid can be a dilute nitric acid, hydrochloric acid, or sulfuric acid of about 5% to about 30%.

The part can then be submerged in a coloring solution containing $H_2SeO_3$, copper nitrate, nitric acid, phosphoric acid, and water. Other components of the solution can include, but are not limited to HCl, $CuSO_4$, and fluoboric acid. The part is submerged for about 30 seconds to about 10 minutes, but preferably about 3 minutes to about 5 minutes, and then removed from the solution.

The part can then be abraded with soft steel wool or other abrasive media, to selectively remove the dark coloring from the areas desired. The part can be kept wet during this abrading process with water, bluing solution, or preferably, but not limited to, light oil.

The use of a block or a semi-rigid part during sanding results in only high or raised areas of the part to be abraded, leaving the low areas untouched, resulting in a shadowed look.

Areas that need darker coloring can be addressed by re-submerging the part in the coloring or bluing solution.

The part can then be rinsed in water. The part can alternatively be blown off with compressed air, wiped with a clean cloth, or other substrate, or otherwise suitably cleaned off.

The part can then be submerged in a metal sealer, which will halt the oxidation effects of the bluing solution and other acidic treatments. This solution can be a non-film forming oil or other compound such as mineral spirits, light machine oil, or other such compound. The excess sealer is then removed.

Example 7

An aluminum electroless NiB-plated part is provided. The provided part can be, but is not limited to, a surface of an upper receiver, lower receiver, buffer tube, charging handle, rail, barrel, muzzle device, and other various miscellaneous gun parts.

The part is blasted with aluminum oxide blast media at about 60 to about 80 PSI. Blast nozzle can be moved in a fast, even, manner and preferably is about 6 inches to about 8 inches away from blast surface. Blasted parts can be removed from the blaster and dried, preferably with compressed air.

The part can then be soaked in coloring solution containing $H_2SeO_3$, copper nitrate, nitric acid, phosphoric acid, and water. Other components of the solution can include, but are not limited to HCl, $CuSO_4$, and fluoboric acid. The part is submerged for about 30 seconds to about 10 minutes, but preferably about 3 minutes to about 5 minutes, and then removed from the solution.

Immediately after soaking, a small amount of a dilute nitric acid, hydrochloric acid, or sulfuric acid of about 5% to about 30% can be applied with a small artist brush or other suitable application device. Acid can be applied selectively to areas on said part to be colored, with the intention of giving the area of application a worn appearance. Areas where acid is to be applied include such areas where corrosion, dirt, and grime would build up over time. The areas include, but are not limited to, all engravings, around the lower portion of the lower magazine well, inner or "cut" areas of picatinny rails, around the forward assist, around the brass deflector, around the ejection port, inside the trigger guard, and so forth. Acid is applied for a length of time preferably of about 10 minutes.

Following acid application, all areas of the part can be wiped down with an oil preferably of high viscosity. "High spots" or raised areas are abraded with an abrasion device, preferably #0000 steel wool wrapped around a sanding sponge. After desired abrasion of said "high spots" is achieved, said part is sprayed with acetone to remove the oil.

The parts can be re-immersed in the coloring solution for a period of time, preferably about 3-4 minutes, with the intention of giving the areas previously treated with acid a darker appearance.

If desired, undertake additional abrasion with an abrasion device, preferably a sanding sponge wrapped with #0000 steel wool. After a suitable degree of additional abrasion is accomplished, the most extreme high or raised spots are burnished with a material, such as Scotch-Brite™ abrasive pads, abrasive sanding sponges, steel wool, abrasive buffing cloth, and powered abrasive buffing wheels.

Then all parts can be fully immersed with a penetrating sealer such as petroleum containing oils, natural or synthetic waxes thinned with solvent, and chromate or zirconium anodizing sealers. Parts are to be soaked for a period of time, preferably two minutes. Parts are dried after soaking, by hang-drying or another suitable method. Dry parts are then cleaned by wiping, blowing with compressed air, or another suitable cleaning method.

Ratios, concentrations, amounts, and other numerical data may be expressed in a range format. It is to be understood that such a range format is used for convenience and brevity, and should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1% to about 5%, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant FIGURE of the numerical value. In addition, the phrase "about 'x' to 'y'" includes "about 'x' to about 'y'".

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

At least the following is claimed:

1. A method for the coloration of an electroless nickel surface or an electroless nickel-plated surface comprising the steps of:

providing the surface; and coloring the surface with a coloring solution, wherein the coloring solution comprises a selenium solution, a copper solution, and one or more acids.

2. The method of claim 1, wherein the surface is selected from the group consisting of electroless nickel-boron, polytetrafluoroethylene-nickel, nickel-boron nitride, and nickel-phosphate.

3. The method of claim 1, wherein the selenium solution is $H_2SeO_3$.

4. The method of claim 1, wherein the one or more acids are at least one of nitric, phosphoric, hydrochloric, and selenious.

5. The method of claim 1, wherein the copper solution is copper sulfate.

6. The method of claim 1, wherein the coloring solution comprises $H_2SeO_3$, copper sulfate, nitric acid, phosphoric acid, and water.

7. The method of claim 1, wherein the coloring solution comprises $H_2SeO_3$, copper nitrate, hydrochloric acid, phosophoric acid, and water.

8. A method for the coloration of an electroless nickel surface or an electroless nickel-plated surface comprising the steps of:

providing the surface;

pretreating the surface with an acid; and coloring the surface with a coloring solution, wherein the coloring solution comprises a selenium solution, a copper solution, and one or more acids.

9. The method of claim 8, wherein the acid is selected from the group consisting of: hydrochloric acid, sulfuric acid, nitric acid, hydrofluoric acid, and fluoboric acid.

10. The method of claim 8, wherein the acid is about 5-30% hydrochloric acid.

11. The method of claim 8, wherein the acid is about 5-30% sulfuric acid.

12. The method of claim 8, wherein the acid is about 5-30% nitric acid.

13. The method of claim 8, wherein the surface is selected from the group consisting of electroless nickel-boron, polytetrafluoroethylene-nickel, nickel-boron nitride, and nickel-phosphate.

14. A method for the coloration of an electroless nickel surface or an electroless nickel-plated surface comprising the steps of:

providing the surface;

selectively patterning the surface with a masking device; and coloring the surface with a coloring solution, wherein the coloring solution comprises a selenium solution, a copper solution, and one or more acids.

15. The method of claim 14, wherein the masking device comprises a thin film polymer with adhesive backing, a polymer plug, or a chemical masking agent.

16. The method claim 15, wherein the polymer plug is PVC, PVDF, silicon, urethane, or rubber, individually or in combination.

17. The method of claim 14, further comprising the step of selectively patterning the surface using a treatment agent with a treatment application device preceding coloring said surface with a coloring solution.

18. The method of claim 14, further comprising the steps of wetting the surface with a wetting solution and selectively abrading the surface with an abrasion device, preceding coloring the surface with a coloring solution;

wherein the wetting solution is selected from the group consisting of: water, the coloring solution, or light oil.

19. The method of claim 18, further comprising the step of rubbing high areas with burnishing materials preceding abrading the surface with an abrasion device and preceding cleaning surface with water, air, or cloth wiping.

20. The method of claim 14, further comprising drying and sealing with a sealant after coloring.

21. The method of claim 14, wherein the surface is selected from the group consisting of electroless nickel-boron, polytetrafluoroethylene-nickel, nickel-boron nitride, and nickel-phosphate.

* * * * *